US006468036B1

(12) United States Patent
Song et al.

(10) Patent No.: US 6,468,036 B1
(45) Date of Patent: Oct. 22, 2002

(54) ADJUSTABLE CRANK OF SWINGING MECHANISM

(76) Inventors: Jiajun Song, 1-913, No. 16 Zeng Guang Road, Hai Dian Qu Beijing 100037 (CN); Hongcai Zhao, 1-913, No. 16 Zeng Guang Road, Hai Dian Qu Beijing 100037 (CN); Wei Song, 2444 Sinclair Rd., Victoria B.C. (CA), V8N 1B3

( * ) Notice: Subject to any disclaimer, the term of this patent is extended or adjusted under 35 U.S.C. 154(b) by 0 days.

(21) Appl. No.: 09/604,844

(22) Filed: Jun. 27, 2000

(51) Int. Cl.[7] ..... F01D 7/00
(52) U.S. Cl. ..... 416/100; 416/99
(58) Field of Search ..... 416/100, 98, 99, 416/101

(56) References Cited

U.S. PATENT DOCUMENTS 1,638,027 A * 8/1927 Galvin et al. ..... 416/100
3,147,639 A * 9/1964 Braskamp ..... 416/100
5,458,462 A * 10/1995 Shao ..... 416/100
5,800,126 A * 9/1998 Tsai ..... 416/100

* cited by examiner

*Primary Examiner*—John Kwon

(57) ABSTRACT

An adjustable crank for adjusting the swinging-angle of a fan comprises a first and a second eccentric disks, the first disk is rotatablely inserted in the second disk, a ring-shape spring is disposed between the engaging surfaces of them to couple them with predetermined torque. A crank pin is eccentrically and integrally formed on the first disk. The second disk is provided with a rotation means for the second disk being turned to rotate about a center axis, which is eccentric with respect to the engaging surfaces. A rotary knob is fixedly mounted on the end of the crankpin for manually turning the first disk to rotate relative to the second disk. Thereby the crank length can be continuously adjusted and self-fixed after being adjusted. Apparently, it is unusually simple in structure, very easy to adjust, especially convenient and cheap in manufacture, and reliable in running.

22 Claims, 8 Drawing Sheets

ADJUSTABLE CRANK OF SWINGING MECHANISM

BACKGROUND OF THE INVENTION

1. Field of the Invention

The present invention relates generally to a crank, and more particularly to an adjustable crank of swinging mechanism, which is particularly adapted for swinging mechanism such as employed in oscillating electric fans or heaters.

2. Description of the Prior Art

Conventional oscillating electric fans available in the market are commonly controlled by an unadjustable swinging mechanism that makes the fan swing at an unadjustable angle range. A user can only choose between a fixed mode (no swing) and a swinging mode with a predefined swinging-angle. Such functions are hard to suit the current environment and meet a user's requirements. U.S. Pat. No. 5,639,213 is an example of such designs, which employs a commonly used crank and rocker mechanism in such an oscillating fan. U.S. Pat. No. 5,720,594 is another example that discloses a crank and slotopening mechanism for a fan oscillating in two axes.

In order to overcome such weakness, many improved schemes have been developed. Among them, some use a crank with changeable length, which leads the swinging-angle adjustable. U.S. Pat. Nos. 3,977,260, 5,217,417 and 5,931,056 are examples of prior patents that disclose such types of fans and also various crank arrangements used for swinging such fans. Unfortunately, the structures of these schemes are so complex that they are hardly adopted and applied widely. As disclosed in China Pat. No. 95240392, a crankpin of the crank can be moved in a slot resulting in corresponding change of the crank length. But such a crank based on above scheme is not convenient for performing swingiong-angle adjusting, and its structure is not simple. Furthermore, even more complex structures may be seen in some other schemes.

SUMMARY OF THE INVENTION

According to the present invention, a novel adjustable crank is provided to solve the problemes mentioned above. Wherein a simple eccentric mechanism is used to change the crank length, an ingenious coupling means is used to self-fix the crank length, an adjusting means is used to conveniently adjust the crank length, furthermore, several additional means are used for making adjustment to the crank length more conveniently.

The adjustable crank according to the present invention comprises a first eccentric disk, a second eccentric disk, a coupling means and an adjusting means. The first disk is provided with a recess having an inner cylindrical surface and an integrally formed crankpin, which is eccentric with respect to the inner cylindrical surface. The second disk is provided with an outer cylindrical surface and a rotation means for the second disk be turned to rotate about a center axis, which is eccentric with respect to the outer cylindrical surface. The second disk is rotatablely inserted in the first disk, and so the inner cylindrical surface and the outer cylindrical surface are engaged each other. The coupling means is disposed between the first and second disks for coupling both of them with predetermined coupling torque. The predetermined coupling torque is large enough to ensure that the relative positions of the first and second disks can be maintained during operation so that power actuating the fan head to swing can be transmitted through the crank. The adjusting means is positioned on the end of the crankpin for manually turning the first disk to rotate relative to the second disk with adjusting torque, which is greater than the coupling torque. Thereby the crank length is adjustable and can be self-fixed after being adjusted. The crank length can be adjusted continuously from zero to the maximum value; correspondingly the swinging-angle of a fan can be adjusted from 0 to a maximum of 120 degrees.

The second disk might provided with a axial mounting hole or with a spindle and a gear, the mounting hole or the spindle and the gear are coaxially disposed with the center axis. Similar to conventional unadjustable cranks the mounting hole is fixedly mounted on an output shaft of an actuating device and actuated to rotate by the output shaft, or the spindle is rotatablely inserted in a locating hole and the gear is actuated to rotate by a pinion of the actuating device. The crankpin is articulated with one end of a connecting rod of a crank and rocker mechanism or slidablely inserted in a slotopening of a crank and slotopening mechanism.

One type of the coupling means is configured such that a pair of annular engaging zones respectively positioned on the first and second disks are forced into coupling together by predetermined elastic force resulted from elastic distortion of at least one of said disks. But then said disks can be forced to rotate relatively by said adjusting means. Said annular engaging zones may be inner cylindrical surface with outer cylindrical surface or annular groove with annular bulge.

Another type of the coupling means comprises a plurality of concaves and at least one convex meshing with the concaves. The concaves and convex are respectively formed on the engaging surfaces of the first disk and second disks. The concaves and the convex can be forced to slip across each other due to elastic deforming of at least one of said disks by said adjusting means, and sound signals and touch signals will be generated at the same time.

Another type of the coupling means comprises a spring means positioned in an annular chamber formed on the engaging surfaces. The spring means can be turned to rotate relative to at least one of said disks and exerts predetermined pressure force on the same disk to couple it with frictional force. Said spring means is selected from the group consisting of metallic round split ring, metallic polygon split ring, elastomeric O-ring, and elastomeric strip, etc. Said annular chamber may be a combination of two annular grooves, one is formed on the first disk and the other on the second disk. Said spring means is partially positioned in one of said grooves and partially positioned in other one so that the axial relative movement of the first and second disks is further limited.

Another type of the coupling means comprises a spring means and at least one steel ball located in a radial hole formed on the second disk, the steel ball is biased to abut against the first disk by predetermined force actuated by the spring means. Furthermore, the first disk can be shaped to include a plurality of concaves or axial grooves formed on the inner cylindrical surface, the steel ball is biased to abut against the concaves or axial grooves. While adjusting crank length, the concaves or axial grooves can be forced to slip across the steel ball, and sound signals and touch signals will be generated at the same time, hereby such coupling means is accompanied by signaling function.

The adjusting means comprises a rotary knob, one end of the rotary knob has an axial hole securely connected with the end of the crankpin; the other end has a handwheel extended out of the through hole formed on the rear housing of the fan motor, so that adjusting torque is directly applied to the handwheel with hand. The handwheel may be concentrical with the crankpin, but preferably is concentrical with the inner cylindrical surface of the first disk.

Alternatively, the adjusting means is configured such that the end of the crankpin being shaped like a screw head, such as slotted head, cross recess head, hex head or square head. Thus, the adjusting torque can be manually applied to the crankpin via a universal screwdriver or other tools.

According to the present invention a signaling means is further comprised for generating sound signal and touch signal during the crank length adjusting process. One type of the signaling means comprises a plurality of axial grooves and at least one axial ridge meshing with said grooves. The grooves and the ridge are respectively formed on the engaging surfaces of the disks. While adjusting cxrank length, said grooves and ridge can be forced to slip across each other due to elastic distortion of at least one of the disks, sound signal and touch signal will be generated at the same time.

According to the present invention a circumferential limiting measns is further comprised, by which the relative rotation of the first and second disks is delimited at two ultimate positions. One of the ultimate positions corresponds to the maximum crank length, and the other one corresponds to the minimum crank length. So the first and second disks can only be to-and-fro turned relatively between these two ultimate positions, one turning direction corresponds to increasing the crank length and the other turning direction corresponds to decreasing the crank length.

One type of the circumferential limiting means includes two axial projecting elements, which are respectively formed on the first and second disks and blocked each other at two ultimate positions. Another type of the circumferential limiting means includes an arc shape groove and an axial projecting element extending into the arc groove, the arc groove and the projecting element are respectively formed on the first and second disks and blocked each other at two ultimate positions.

According to the present invention an axial limiting means is further comprised to limit axial relative movement of the disks. Said limiting means includes a pair of annular shoulders adjacent each other formed respectively on said engaging surfaces. In an alternative way, said limiting means includes an annular bulge and an annular groove formed respectively on said engaging surfaces and meshed each other.

The first disk, second disk and rotary knob as described above can be made of metal or plastic material, but preferably are molded from plastic.

When adjusting crank length, user only need to turn the rotary knob to change the crank length and then the crank length is self-fixed at the desired value by the coupling means. All appearance, the adjustable crank according to the present invention therefore has the advantages of being especially simple in structure, being significantly convenient and cost effective in manufacture, being very easy to adjust during operation and being reliable in running.

Accordingly, it is a principal object of the present invention to provide an adjustable crank, which is especially simple in structure and easy to adjust the crank length.

It is a further object of the present invention to provide a coupling means, which can be used to fix the crank length automatically after the crank length being adjusted.

It is a further object of the present invention to provide an adjusting means, which can be used to adjust the crank length conveniently.

It is an additional object of the present invention to provide a signaling means, which can be used to adjust the crank length efficiently.

It is an additional object of the present invention to provide a circumferential limiting means, which can be used much more conveniently to adjust the crank length.

Further object and advantage is to provide an adjustable crank, which can be simply used to replacing the constant length crank of the existing oscillating fans.

Other objects and advantages will become apparent from a consideration of the ensuing drawings and description.

DETAILED DESCRIPTION OF THE INVENTION

Figure 1:
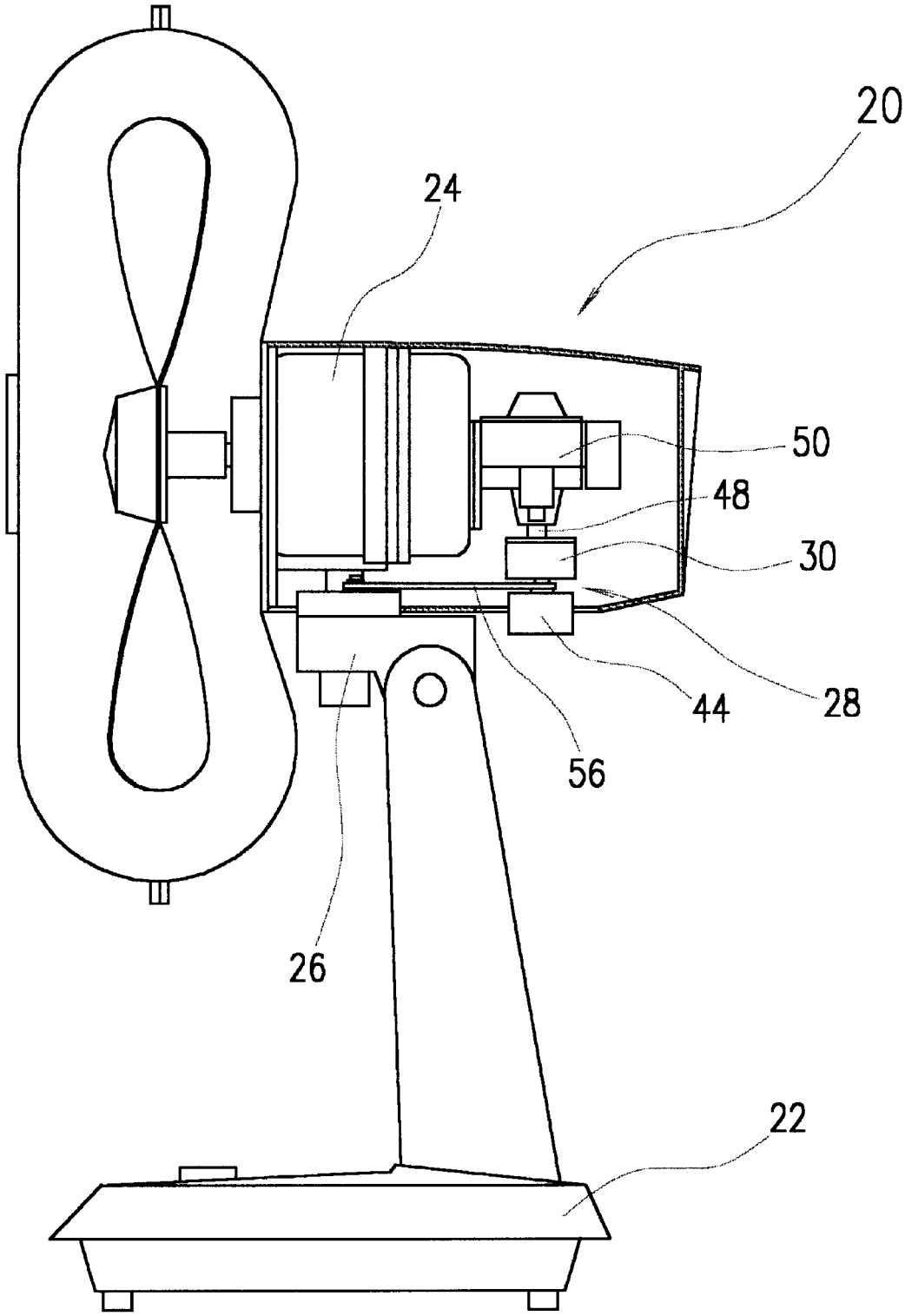
FIG. 1 is a front elevation view of an oscillating fan embodying an adjustable crank according to the present invention.

FIG. 1 is a front elevation view of a novel fan 20. Visible in this view are a base or pedestal 22 for supporting said fan on an environmental surface, a fan motor and fan blade assembly 24 for propelling air, a connecting device 26 for connecting said fan motor and fan blade assembly 24 pivotally on said base 22, and a swinging mechanism 28 containing an adjustable crank 30 which provides the principal novel features of the present invention.

Figure 2:
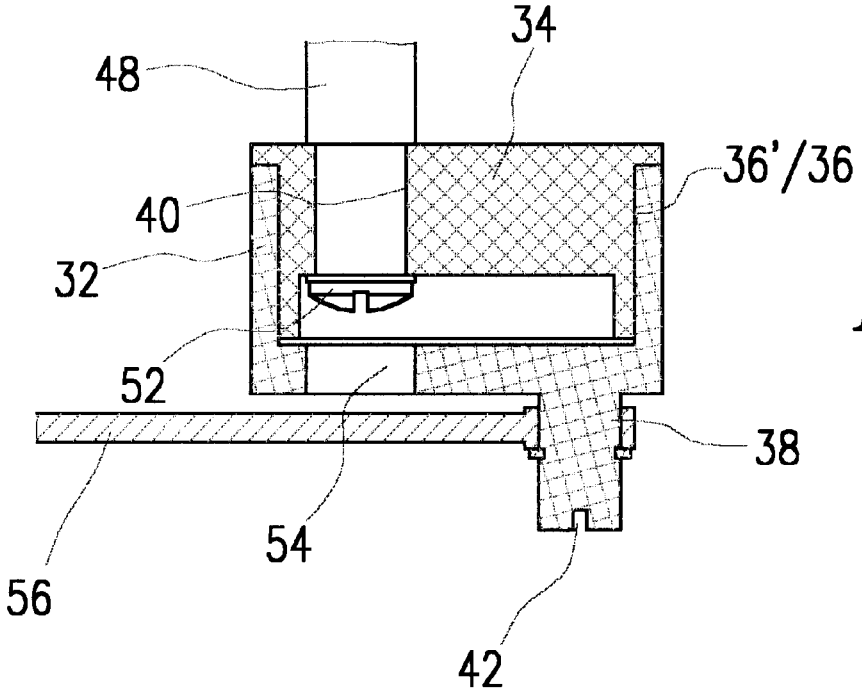
FIG. 2 is a sectional view of an essential embodiment of an adjustable crank according to the present invention.

As shown in FIG. 2, the essential embodiment of the adjustable crank according to the present invention comprises a first eccentric disk 32, a second eccentric disk 34, a coupling means and an adjusting means. Disk 32 is shaped to include an inner cylindrical surface 36 and an integrally formed crankpin 38. Crankpin 38 is eccentric with respect to inner cylindrical surface 36. Disk 34 is shaped to include an outer cylindrical surface 36' and an axial mounting hole 40. Outer cylindrical surface 36' is eccentric with respect to mounting hole 40. Disk 34 is rotatablely inserted in disk 32 to form an eccentric mechanism. Inner cylindrical surface 36 is engaged with outer cylindrical surface 36'. Used as a coupling means, the engaging surfaces are forced into coupling together by predetermined elastic force of disk 32 itself. The adjusting means is simply a slot 42 formed on the end of crankpin 38, it is used for manually turning disk 32 with screwdriver. Therefore disk 32 and disk 34 are coupled together by the predetermined coupling torque. The coupling torque is kept constant on said engaging surfaces, but then disk 32 can be manually forced to rotate relative to disk 34 by said adjusting means.

Figure 3:
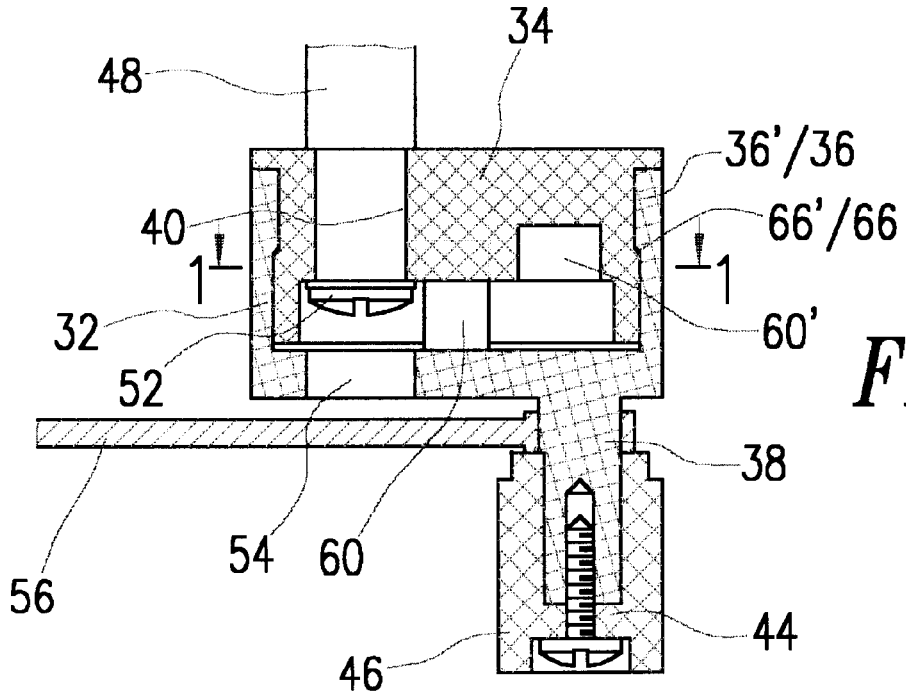
FIG. 3 is a sectional view similar to FIG. 2, wherein a circumferential limiting means and an axial limiting device are further comprised and the adjusting means comprises a rotary knob.
Figure 5:
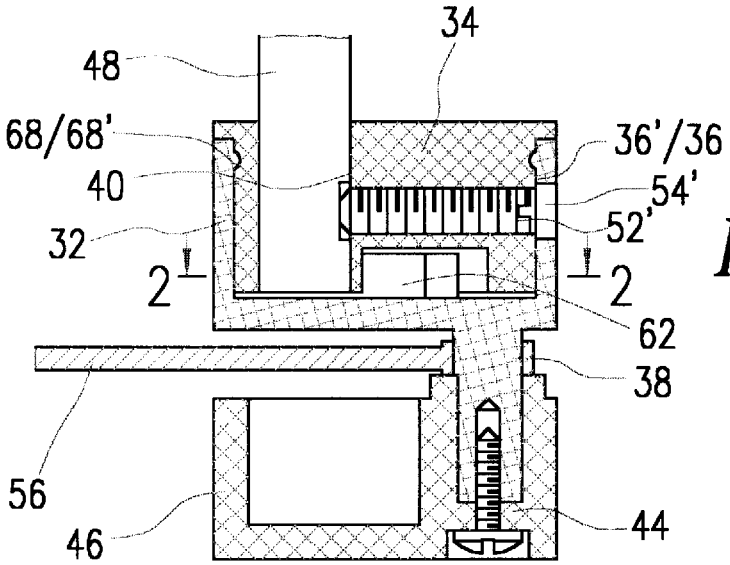
FIG. 5 is a sectional view similar to FIG. 3 showing the alternative circumferential limiting means, axial limiting means and a modified rotary knob.

An alternative adjusting means, which comprises a rotary knob 44, can be seen in FIGS. 3 and 5. One end of rotary knob 44 has a hole fixedly mounted on the end of crankpin 38, and the other end has a handwheel 46 extended out of the through hole of the protective cover of the fan motor (not shown). The axis of handwheel 46 may be concentric with the axis of crankpin 38 as shown in FIG. 3 or concentric with the axis of inner cylindrical surface 36 as shown in FIG. 5. One may directly turn rotary knob 44 to adjust the crank length.

An additional axial limiting device may be further included to limit axial relative movement of disk 32 and disk 34. One type of the limiting device is a pair annular steps or shoulders 66 and 66' adjacent each other, which are respectively formed on inner cylindrical surface 36 and outer cylindrical surface 36' as shown in FIG. 3. Another type of the axial limiting device is an annular groove 68 and a annular bulge 68', which are respectively formed on inner cylindrical surface 36 and outer cylindrical surface 36' as shown in FIG. 5.

Figure 7:
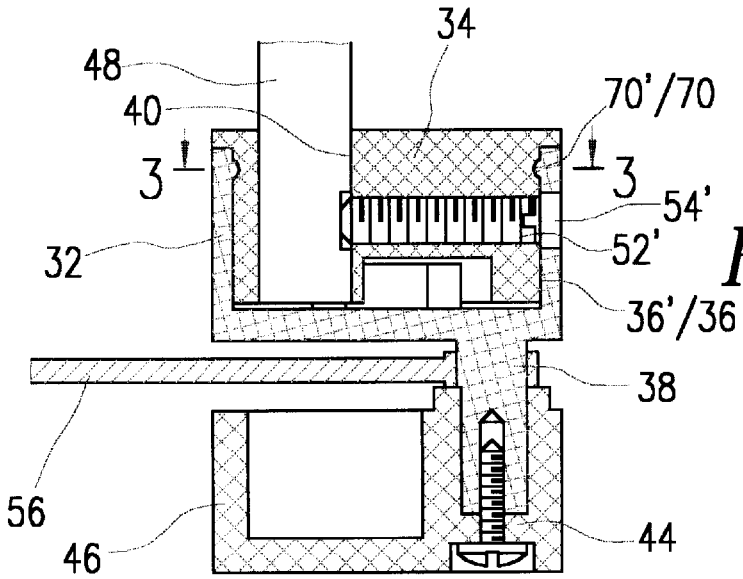
FIG. 7 is a sectional view similar to FIG. 5 showing the alternative coupling means according to the present invention.
Figure 8:
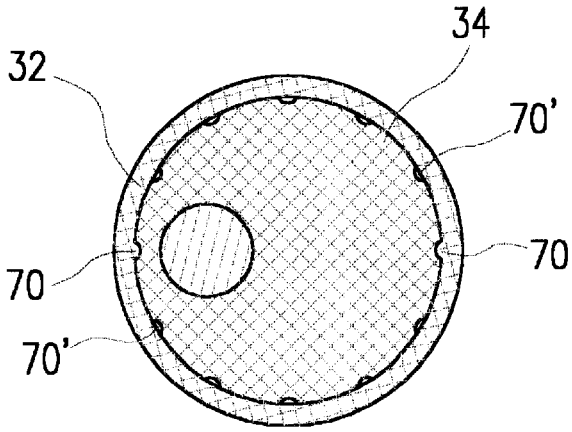
FIG. 8 is a cross sectional view taken along line 3—3 in FIG. 7.

As shown in FIGS. 7 and 8, used as an alternative coupling means, a plurality of concaves 70' are formed on outer cylindrical surface 36' of disk 34. Two convexes 70 meshed with concave 70' are formed on inner cylindrical surface 36 of disk 32. Therefore disk 32 and disk 34 are coupled together by predetermined meshinmg force. But then convexes 70 can be forced to slip across concaves 70' due to elastic deforming of disk 32, and sound signals and touch signals can be sent out at the same time. Said sound and touch signals are helpful to feel the magnitude of crank length changing.

Figure 10:
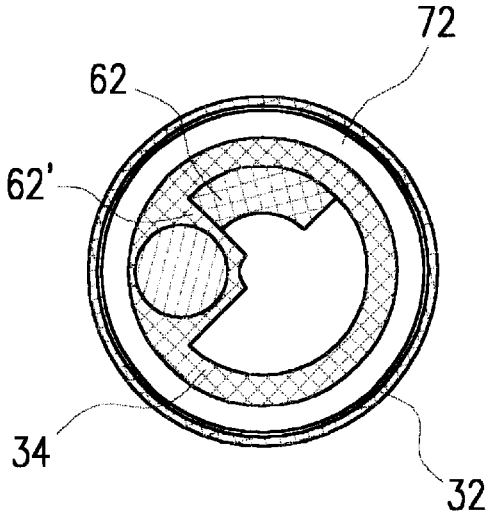
FIG. 10 is a cross sectional view taken along line 4—4 in FIG. 9.
Figure 9:
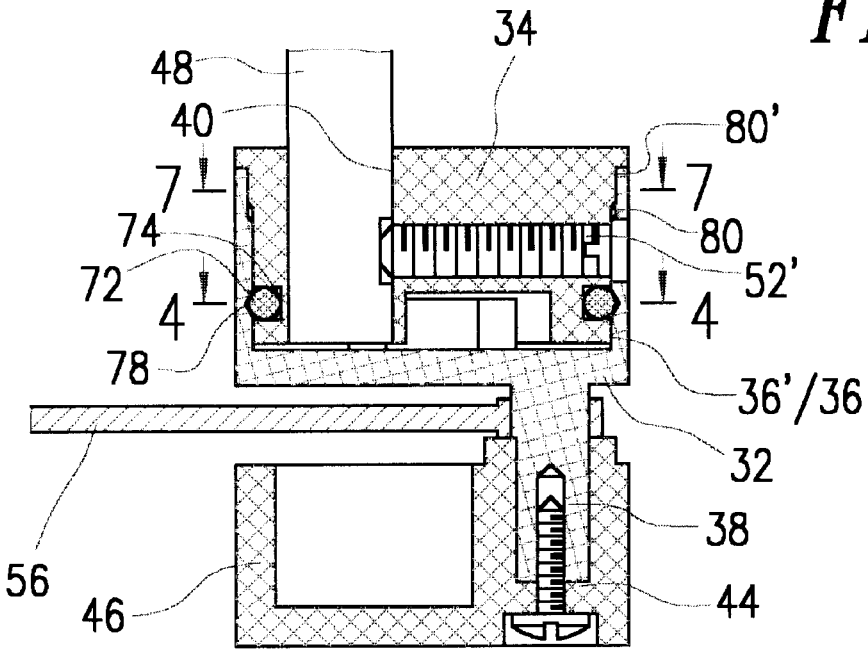
FIG. 9 is a sectional view of a further embodiment of an adjustable crank according to the present invention wherein the coupling means comprises an elastomeric ring.
Figure 11:
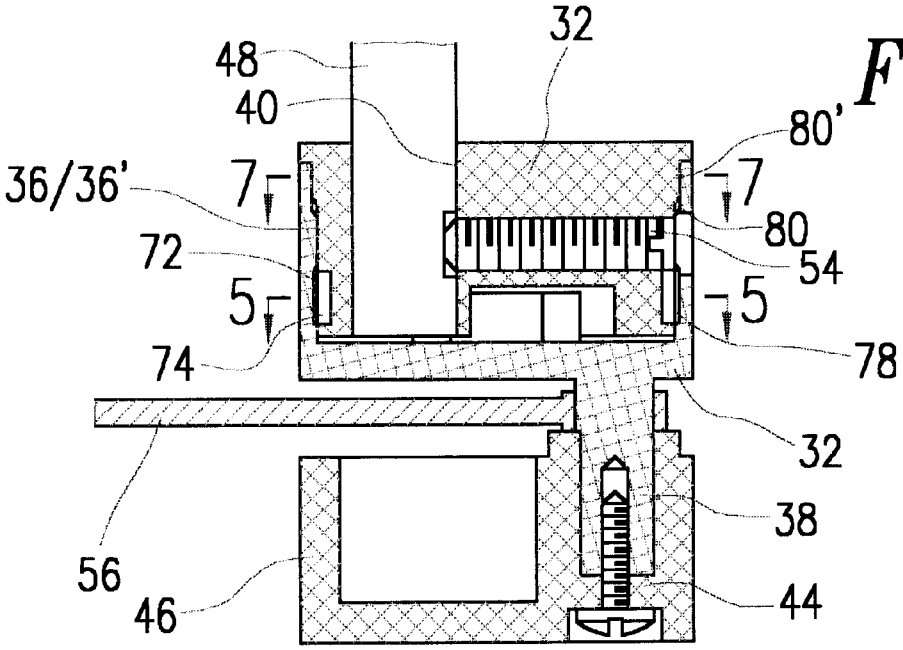
FIG. 11 is a sectional view similar to FIG. 9 showing the alternative spring means, which is a metallic polygon split ring.
Figure 13:
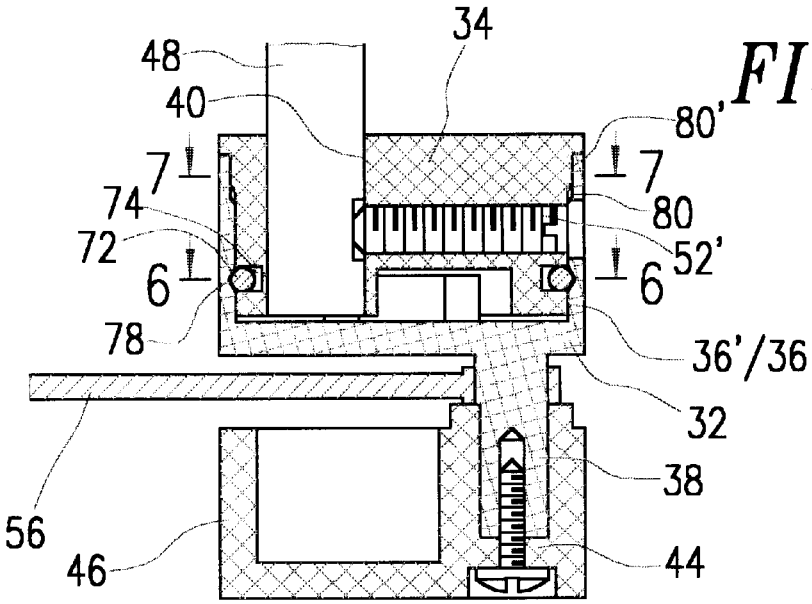
FIG. 13 is a sectional view similar to FIG. 9 showing the alternative spring means, which is a metallic round split ring.
Figure 12:
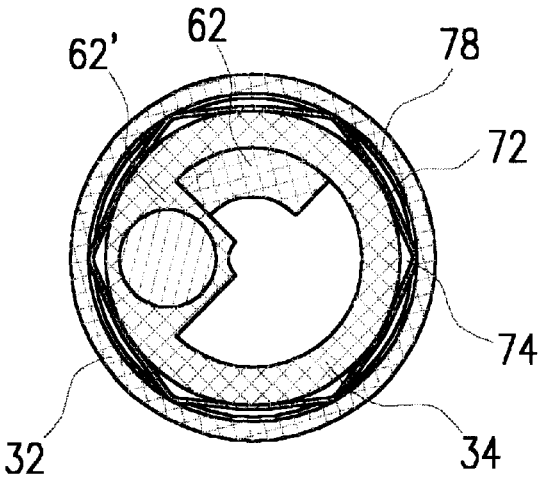
FIG. 12 is a cross sectional view taken along line 5—5 in FIG. 11.
Figure 14:
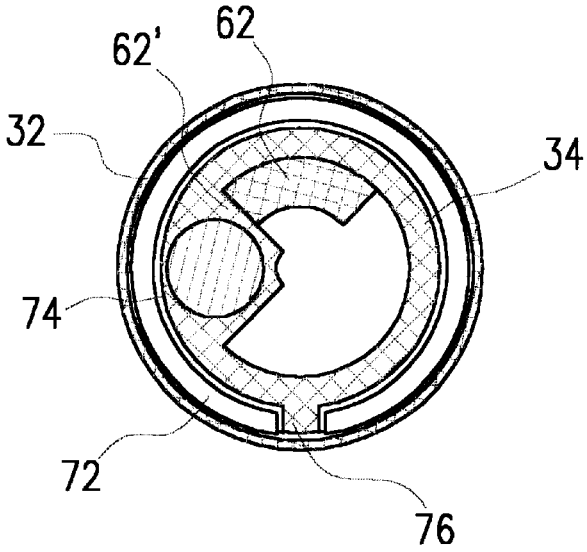
FIG. 14 is a cross sectional view taken along line 6—6 in FIG. 13.

As shown in FIGS. 9 to 15, another alternative coupling means further comprises a spring means 72, which is arranged in an annular chamber 74 formed on the engaging surfaces of disks 32 and 34. Spring means 72 may be an O-ring molded from elastic rubber or plastic as shown in FIGS. 9 and 10. It exerts pressure force on both disks 32 and 34 and can be forced to rotate relative to both disks 32 and 34 by adjusting means. As shown in FIGS. 11 and 12, wherein alternative spring means 72 is a steel polygon split ring. It exerts pressure force on both disks 32 and 34 and can be forced to rotate relative to both disks 32 and 34 by adjusting means too. As shown in FIGS. 13 and 14, wherein alternative spring means 72 is a steel round split ring. It exerts pressure force on disk 32 only. It can be forced to rotate relative to disk 32 by adjusting means, but is prevented from rotating relative to disk 34 by a stopper 76. Therefore disk 32, spring means 72 and disk 34 are coupled together. The predetermined coupling torque (friction torque) is large enough to ensure that the relative position of them can be maintained during operation, and disk 32 can be manually forced to turn relative to disk 34 by said adjusting means to changing the crank length.

In order to further limit axial relative movement of disk 32 and disk 34, as shown in FIGS. 9, 11, and 13, an annular groove 78 is formed on inner cylindrical surface 36 of disk 32, spring means 72 is partially positioned into and abut against annular groove 78.

As shown in FIGS. 9, 11, 13, and 15, used as an additional signaling means a plurality of axial grooves 80 and two axial ridges 80' meshed with grooves 80 are respectively formed on said engaging surfaces. While adjusting the crank length, grooves 80 can be forced to slip across ridges 80' due to elastic deforming of disk 32 and sound signals and touch signals can be sent out at the same time.

Figure 16:
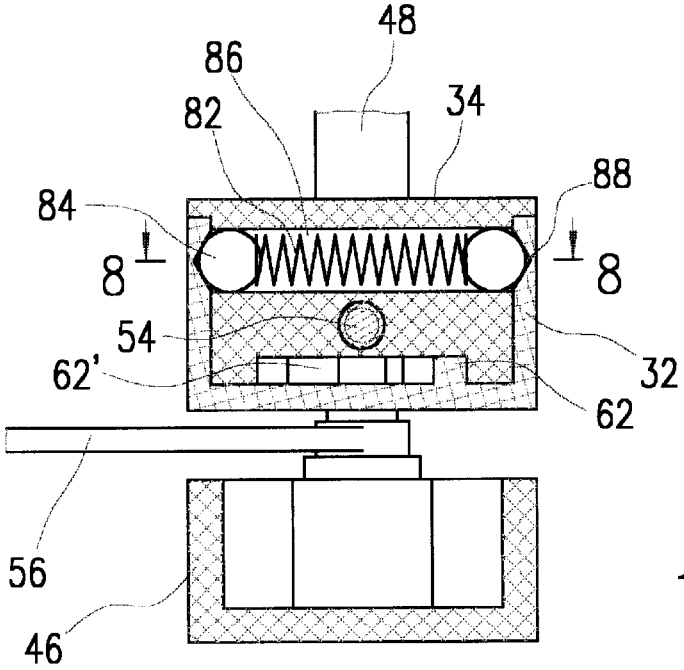
FIG. 16 is a sectional view of a further embodiment, in which the coupling means comprises two steel balls and a compression spring.
Figure 15:
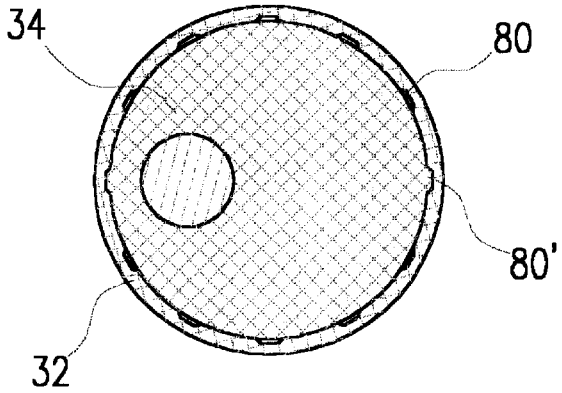
FIG. 15 is a cross sectional view taken along line 7—7 in FIGS. 9, 11, 13.
Figure 17:
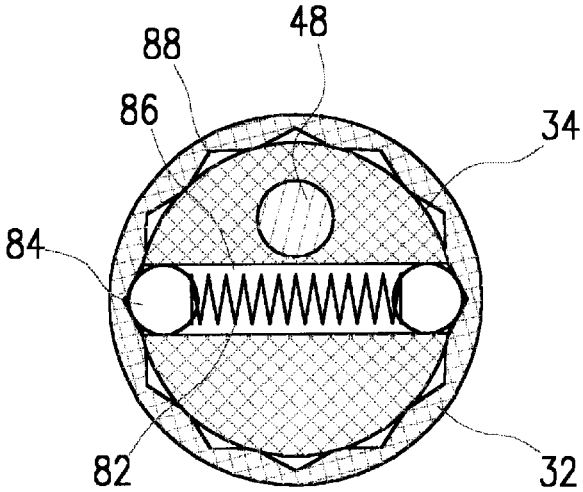
FIG. 17 is a cross sectional view taken along line 8—8 in FIG. 16.

As shown in FIGS. 16 and 17, used as an alternative coupling means, one compression spring 82 and two steel balls 84 are located in a radial hole 86 formed on disk 34, and disk 32 is shaped to include a plurality of concaves 88. Steel balls 84 apply predetermined pressure force actuated by spring 82 on concaves 88, but then concaves 88 can be forced to slip across steel balls 84 and sound signals and touch signals can be sent out at the same time.

Figure 4:
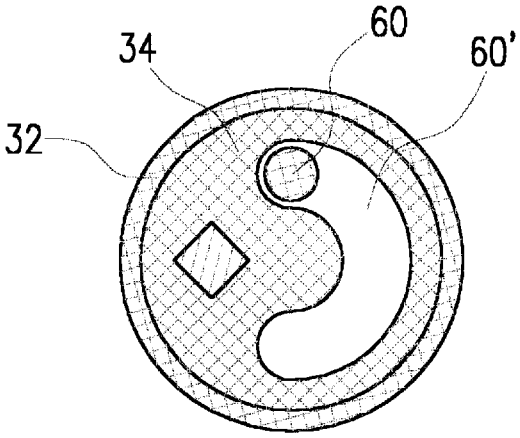
FIG. 4 is a cross sectional view taken along line 1—1 in FIG. 3.
Figure 6:
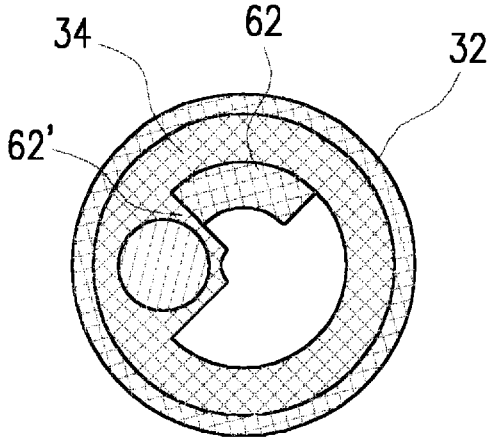
FIG. 6 is a cross sectional view taken along line 2—2 in FIG. 5.

As shown in FIGS. 3 to 6, an additional circumferential limiting means may be further comprised. Herein an arc shape groove 60' and an axial projecting element 60 extending into arc groove 60' are formed respectively on disks 34 and 32 as shown in FIGS. 3 and 4. Arc shape groove 60 and axial projecting element 60' are blocked each other at two ultimate positions of relative rotation between disks 32 and 34. One is the maximum crank length position, and the other is the minimum crank length position. Therefore disk 32 can only be to-and-fro turned relative to disk 34 such that one turning direction increases the crank length and the other decreases the crank length. Alternatively used as a limiting means two axial projecting elements 62 and a 62' are formed respectively on disks 32 and 34 as shown in FIGS. 5 and 6.

As shown in FIGS. 1, 2 and 5, mounting hole 40 is securely connected with an output shaft 48 of an actuating device 50 by screw 52 or 52'. There is an opening 54 or 54' on the disk 32 for assembling or disassembling adjusable crank. Crankpin 38 is articulated with one end of a connecting bar 56 of a crank and rocker mechanism 58 as shown in FIG. 1 or inserted into a slotopening of a crank and slotopening mechanism (not shown). The adjustable crank is actuated to rotate by output shaft 48. Power is transmitted from the actuating device 50 to connecting bar 56 through output shaft 48, disk 34, coupling means and disk 32. Said predetermined coupling torque is large enough to withstand the reaction torque caused by connecting bar 56 or the slotopening during operation and therefore to ensure that the crank length can be kept. While adjusting crank length, you may directly turn rotary knob 44 or use a screwdriver to force slot 42 to turn. Thereby disk 32 will be rotated relative to disk 34, and the crank length will be changed to a suitable value. Then the crank length will be self-fixed by the coupling means. And the fan will swing with a new swinging-angle, which is determined by the changed crank length.

Figure 18:
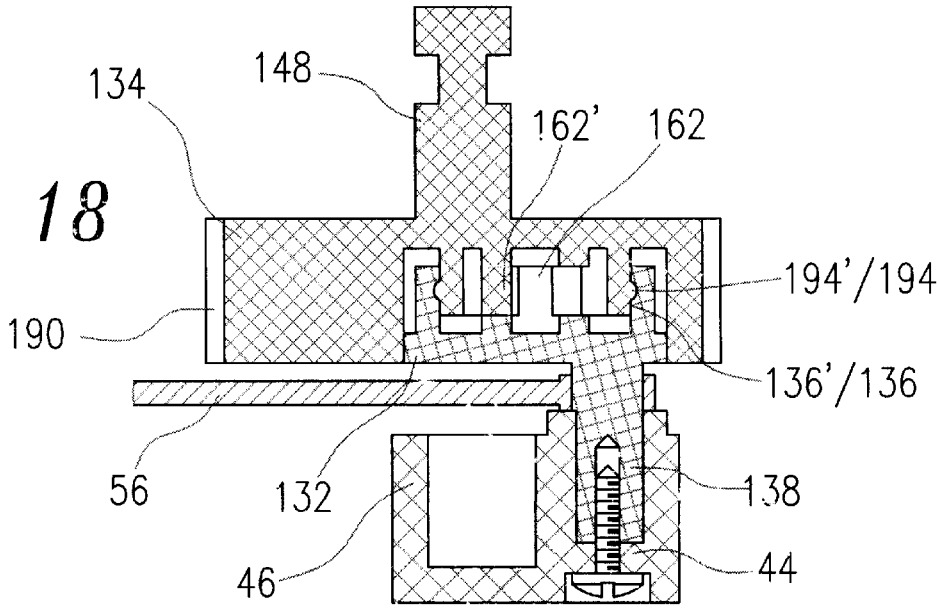
FIG. 18 is a sectional view of a further embodiment, in which a gear and a spindle are integrally formed with the second disk.

FIG. 18 shows another embodiment of the adjustable crank according to the present invention. Which comprises a first disk 132, a second disk 134, a coupling means and an adjusting means. Disk 132 is shaped to include an inner cylindrical surface 136, an integrally formed crankpin 138 eccentric with respect to inner cylindrical surface 136, and an annular groove 194 coaxially formed on inner cylindrical surface 136. Disk 134 is shaped to include an outer cylindrical surface 136', a spindle 148, a gear 190, and an annular bulge 194' coaxially formed on outer cylindrical surface 136'. Spindle 148 and gear 190 are eoncentric with respect to outer cylindrical surface 136'. Disk 134 is rotatablely inserted into disk 132. Groove 194 and bulge 194' are forced into engaging each other by elastic force of disks 132 and 134, so that disks 132 and 134 are coupled together. Used as a limiting means two axial projecting elements 162 and 162' are respectively formed on disks 132 and 134.

Figure 19:
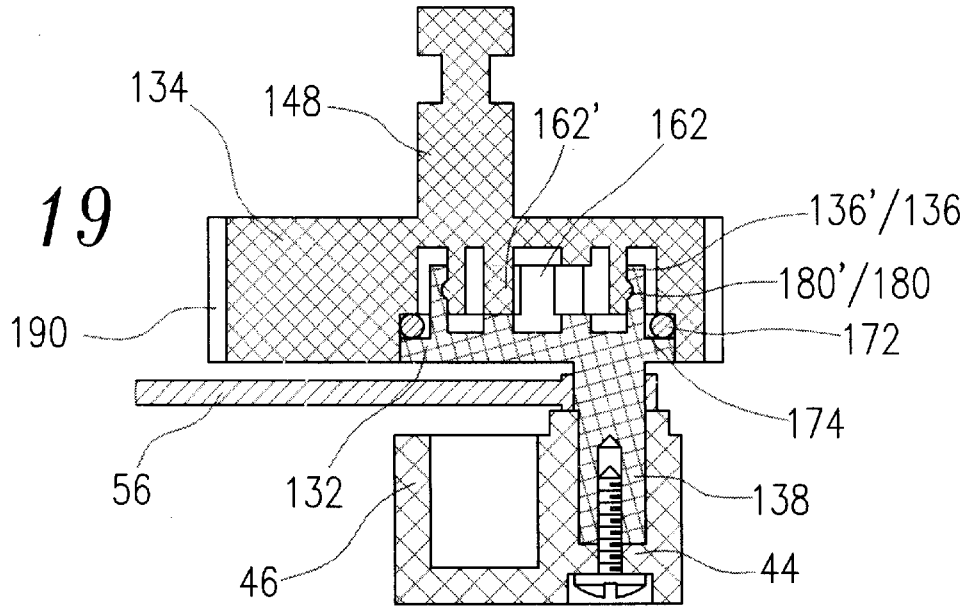
FIG. 19 is a sectional view similar to FIG. 18 showing the alternative coupling means, which comprises a spring means.

As shown in FIG. 19, an alterlative coupling means comprises a metallic round split ring 172 positioned in an annular chamber disposed between disks 132 and 134. Split ring 172 is rotatable relative to disk 132 and exerts predetermined pressure force on disk 132, but is prevented from turning relative to disk 134 by a stopper. Used as a signaling means a plurality of concaves 180 and two convexes 180' meshing with concaves 180 are respectively formed on engaging surfaces 136 and 136'.

Similar to a conventional unadjustable crank, the spindle 148 is rotatablely mounted in a hole under an actuating device, and gear 190 is meshed with a pinion of the actuating device (not shown). The disk 134 is actuated to rotate about the axis of spindle 148 by the pinion. The structures of the other part are the same as that described above and therefore the description is omitted here.

The embodimentes of the present invention are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. An adjustable crank of swinging mechanism comprising:

a first eccentric disk provided with a recess having an inner cylindrical surface and an integrally formed crankpin eccentric with respect to the inner cylindrical surface;

a second eccentric disk provided with an outer cylindrical surface and a means for said second disk be turned to rotate about a center axis eccentric with respect to the outer cylindrical surface, said second disk being rotablely inserted in said first disk, said inner cylindrical surface and outer cylindrical surface being engaged to each other;

a coupling means for coupling said first and second disks with predetermined torque; and an adjusting means for manually turning said first disk to rotate relative to said second disk, whereby the distance between said center axis and the axis of said crankpin is varied.

2. The adjustable crank as claimed in claim 1 wherein said coupling means is configured such that a pair of engaging zones respectively positioned on said disks are forced into coupling together by predetermined elastic force resulted from elastic distortion of at least one of said disks.

3. The adjustable crank as claimed in claim 1 wherein said coupling means comprises a plurality of concaves and at least one convex meshing with said concaves, said concaves and said convex are respectively formed on said engaging surfaces of said disks, said concaves can be forced to slip across said convex due to elastic deforming of at least one of said disks by said adjusting means.

4. The adjustable crank as claimed in claim 1 wherein said coupling means is able to generate signal during the crank length adjusting process.

5. The adjustable crank as claimed in claim 3 wherein said coupling means comprises a spring means positioned in an annular chamber disposed between said first and second disks, said spring means can be turned to rotate relative to at least one of said disks and exerts predetermined force on the same disk.

6. The adjustable crank as claimed in claim 5 wherein said spring means is selected from the group consisting of metallic round split ring, metallic polygon split ring, elastomeric O-ring, and elastomeric strip.

7. The adjustable crank as claimed in claim 5 further comprises a signaling means for generating signal during the crank length adjusting process.

8. The adjustable crank as claimed in claim 7 wherein said signaling means comprises a plurality of axial grooves and at least one axial ridges meshing with said axial grooves, said axial grooves and axial ridges are respectively formed on said engaging surfaces.

9. The adjustable crank as claimed in claim 1 wherein said coupling means comprises a spring means and at least one steel ball located in a radial hole formed on said second disk, said steel ball is biased to abut against said first disk by said spring means.

10. The adjustable crank as claimed in claim 9 wherein said inner cylindrical surface comprises a plurality of concaves, said steel ball is biased to abut against said concave by said spring means.

11. The adjustable crank as claimed in claim 1 wherein said adjusting means is configured such that the end of said crankpin is shaped like a screw head.

12. The adjustable crank as claimed in claim 1 wherein said adjusting means comprises a rotary knob, which having a handwheel and an axial hole securely connected with said crankpin.

13. The adjustable crank as claimed in claim 12 wherein said handwheel is concentric with said inner cylindrical surface.

14. The adjustable crank as claimed in claim 12 wherein said rotary knob is molded from plastic.

15. The adjustable crank as claimed in claim 1 further comprising a circumferential limiting means, by which the relative rotation of said disks being delimited at two ultimate positions, one of said ultimate positions corresponding to the maximum crank length and the other one corresponding to the minimum crank length.

16. The adjustable crank as claimed in claim 15 wherein said circumferential limiting means includes two axial projecting elements respectively formed on said disks, said projecting elements are blocked each other at two ultimate positions.

17. The adjustable crank as claimed in claim 15 wherein said circumferential limiting means includes an arc shape groove and an axial projecting element extending into said arc groove, said arc groove and projecting element are respectively formed on said disks and blocked each other at two ultimate positions.

18. The adjustable crank as claimed in claim 1 wherein said first and second disks are molded from plastic.

19. The adjustable crank as claimed in claim 1 further comprises an axial limiting means for limiting axial relative movement of said first and second disks.

20. The adjustable crank as claimed in claim 19 wherein said axial limiting means includes a pair of annular shoulders adjacent each other formed respectively on said engaging surfaces.

21. The adjustable crank as claimed in claim 19 wherein said axial limiting means includes an annular bulge and an annular groove formed respectively on said engaging surfaces and meshed each other.

22. In a oscillating fan having a fan motor and fan blade assembly for propelling air, a base for supporting said fan on an environmental surface, a connecting device for mounting said fan motor and fan blade assembly pivotally on said base, and at least one swinging mechanism for swinging said fan motor and fan blade assembly, wherein the improvement is said swinging mechanism having an adjustable crank comprising:

a first eccentric disk provided with a recess having an inner cylindrical surface and an integrally formed crankpin eccentric with respect to the inner cylindrical surface;

a second eccentric disk provided with an outer cylindrical surface and a means for said second disk be turned to rotate about a center axis eccentric with respect to the outer cylindrical surface, said second disk being rotablely inserted in said first disk, said inner cylindrical surface and outer cylindrical surface being engaged to each other;

a coupling means for coupling said first and second disks with predetermined torque; and an adjusting means for manually turning said first disk to rotate relative to said second disk, whereby the swinging-angle of said fan is varied.

* * * * *